US006756073B2

(12) United States Patent
Kashirin et al.

(10) Patent No.: US 6,756,073 B2
(45) Date of Patent: Jun. 29, 2004

(54) METHOD FOR APPLYING SEALING COATING WITH LOW GAS PERMEABILITY

(75) Inventors: Aleksandr Ivanovich Kashirin, Obninsk (RU); Oleg Fedorovich Kljuev, Obninsk (JP); Aleksandr Viktorovich Shkodkin, Obninski (RU)

(73) Assignee: Obschestvo S Ogranichennoi Otvetstvennoctiju Obninsky Tsentr Poroshkovogo Napyleniya, Obninsk (RU)

( * ) Notice: Subject to any disclaimer, the term of this patent is extended or adjusted under 35 U.S.C. 154(b) by 0 days.

(21) Appl. No.: 10/312,154

(22) PCT Filed: Aug. 23, 2001

(86) PCT No.: PCT/RU01/00350

§ 371 (c)(1),
(2), (4) Date: Dec. 20, 2002

(87) PCT Pub. No.: WO02/052064

PCT Pub. Date: Jul. 4, 2002

(65) Prior Publication Data

US 2003/0091755 A1 May 15, 2003

(30) Foreign Application Priority Data

Aug. 25, 2000 (RU) ..... 00122331

(51) Int. Cl.[7] ..... B05D 1/12

(52) U.S. Cl. ..... 427/201; 427/191; 427/193; 427/427

(58) Field of Search ..... 427/180, 191–193, 427/201, 140, 142, 422, 427, 426, 421; 148/537

(56) References Cited

U.S. PATENT DOCUMENTS 5,302,414 A 4/1994 Alkhimov et al.

6,139,913 A 10/2000 Van Steenkiste et al.

FOREIGN PATENT DOCUMENTS

| | | | |
|---|---|---|---|
| EP | 484 533 | * | 5/1992 |
| EP | 0 484 533 B1 | | 5/1992 |
| RU | 2038411 | * | 6/1995 |
| RU | 2 038 411 C1 | | 6/1995 |
| RU | 2 062 820 C1 | | 6/1996 |
| RU | 2 082 823 C1 | | 6/1996 |
| SU | 1 618 778 A1 | | 1/1991 |
| SU | 1 618 782 A1 | | 1/1991 |
| WO | WO 91/19016 A1 | | 12/1991 |

OTHER PUBLICATIONS

A. Khasui, "Spraying Technique", translated from Japanese by S.L. Maslennikov, Moscow Mashinostroenie Publishing House, title page and pp. 175–176 together with English language translation thereof.

* cited by examiner

*Primary Examiner*—Fred J. Parker
(74) *Attorney, Agent, or Firm*—Frishauf, Holtz, Goodman & Chick, P.C.

(57) ABSTRACT

A method is provided for applying metallic or metal-ceramic coatings to a product surface, particularly during the manufacture and repair of pressurized articles and products which require increased corrosion resistance, heat resistance and other qualities. Compressed air is preliminary heated to a temperature of from 400 to 700° C., forming a high-velocity air flow in a supersonic nozzle. A powder material, which is a mechanical mixture of ceramic and metal powders, is accelerating by the flow and is applied to a product surface. The metal powder is a powder mixture of at least two metals, one of which is zinc powder in an amount of from 20 to 60% of the metal powder total weight. The presence of zinc in the powder material and the heating of the compressed air to 400 to 700° C. assures high-efficiency production of coatings having low gas-permeability and high coating-to-substrate bond strength.

8 Claims, No Drawings

METHOD FOR APPLYING SEALING COATING WITH LOW GAS PERMEABILITY

CROSS-REFERENCE TO RELATED APPLICATIONS

This application is a U.S. National Phase Application under 35 USC 371 of International Application No. PCT/RU01/00350 filed Aug. 23, 2001.

FIELD OF THE INVENTION

This invention relates to the technology of producing coatings on the surface of products, and in particular to methods of producing coatings with the use of an inorganic powder, and it may be employed in different branches of mechanical engineering, particularly during the manufacture and repair of products which require impermeability, increased corrosion resistance, heat resistance and other qualities.

BACKGROUND OF THE INVENTION

At present, known in the art are several methods of gas-dynamic applying metallic coatings of powder materials characterized by acceleration of particles by means of a supersonic gas flow without using any combustible gases or liquids.

It is known to produce coatings by a method of applying aluminium powder accelerated by a supersonic gas flow (SU 1618782). The main disadvantage of this method is low efficiency due to the use of cold aluminium particles accelerated to relatively low velocities. This results in the fact that only a small amount of particles can stick to a substrate, thus leading to an increase in the powder material consumption and coating producing time.

Known in the art are also methods of producing coatings which comprise applying to a substrate (base) the metal powders introduced into a gas flow and accelerated along with the gas flow in a supersonic nozzle (SU 1618778, EP 0484533, U.S. Pat. No. 5,302,414). In these methods, the acceleration of powder particles to higher velocities (up to 1200 m/s) is employed. In some cases these methods enable one to produce coatings with the enhanced coating bond strength and low porosity.

However, it has only been possible to attain low gas-permeability of coatings at very low efficiency of spraying (low deposition efficiency). Besides, these methods are rather expensive and technically complicated, since for their realization it is essential that expensive gases (such as helium) and high pressure of the working gas (from 15 to 20 atm.) should be used. This causes considerable increase in the cost of equipment and makes the technology of applying the coatings more complicated. Therefore, these methods are little used industrially.

A further prior art method of producing coatings comprises accelerating a mechanical mixture of particles by a gas flow preliminary heated to a temperature ranging from 20° C. to 320° C. (RU 2082823). In this method, the gas heating temperature and gas flow rate are substantially limited (Mach number is less than 2); as a result, said method does not make it possible to form high-impermeable coatings with high productivity.

A still further prior art method of producing coatings makes use of a metal powder which comprises several components and is accelerated to supersonic velocities in a carrier gas flow heated to a temperature which is in the range from 0.3 to 0.9 that of initial melting (RU 2062820). In this case, using in particular a mixture of copper and zinc, one attains good electrical conductivity and wear resistance of the coatings. The major disadvantage of this method is that the coatings produced have low coating-to-substrate bond strength and, besides, the technology of producing a coating becomes complicated through the necessity of applying it at a definite angle with respect to the surface.

Thus, with the above methods it is practically impossible to ensure low gas-permeability (high impermeability) of the resulting coatings.

The most similar to the claimed solution is a method of producing coatings comprising accelerating in a supersonic nozzle, by a preheated air flow, and applying to a product surface a powder material which comprises a mechanical mixture of ceramic and metal powders. In this method, preheating of compressed air, forming a high-speed air flow in the supersonic nozzle, and accelerating the powder material by this flow are provided. These make it possible to produce the coatings with high coating bond strength and low porosity at relatively low costs (RU 2038411).

This method while having sufficiently high productivity, nevertheless, fails to ensure impermeability of the coating, especially when applying thin-layer coatings. With such a technology thin-layer coatings, in spite of low porosity, are not completely gas-impermeable (gas-tight) in many cases.

The present invention has for its object the improvement in quality of the coatings, and namely reduction in gas-permeability with the retention of high coating bond strength and process efficiency.

SUMMARY OF THE INVENTION

The given object is accomplished by the fact that in the known method of producing coatings comprising accelerating in a supersonic nozzle by a preheated air flow, and applying to a product surface a powder material which comprises a mechanical mixture of ceramic and metal powders, a powder mixture of at least two metals is employed as a metal powder, one of which being zinc powder in an amount of from 20 to 60% of the metal powder total weight, air being preliminary heated to a temperature of from 400 to 700° C.

Depending on the substrate material and coating operating conditions, in the metal powder along with zinc powder one employs, in particular aluminium powder, copper powder or a mechanical mixture thereof.

It is advantageous that the powders with a particle size of from 5 to 50 $\mu$m be employed as a ceramic powder.

It is more advantageous that aluminium oxide powder, silicon carbide powder or their mixtures be employed as a ceramic powder.

The method of the present invention is distinguished from the prior art method by the fact that in the working powder composition it is necessary to employ zinc powder in a definite amount of from 20 to 60% of the metal powder total weight, and to heat compressed air to a higher temperature, namely up to 400 to 700° C.

DETAILED DESCRIPTION

The gist of the method in accordance with the invention resides in the following.

It is well known that when a powder mixture of different metals is used for applying coatings, it is possible to obtain specific required properties of the coatings, such as increased wear resistance or electrical conductivity (RU 2062820).

Since gas-permeability of coatings depends basically on the structure of boundaries between the particles in a coating, in order that closer contact between the particles be obtained, one could include into a composition of the powder material to be sprayed a metal having high plasticity, for instance zinc as one of the cheapest and most available materials. At the same time, as practice of gas-thermal spraying of coatings has shown (A. Khasui. Tekhnika Napylenia/Spraying Technique/. Mashinostroenie Publishing House, Moscow. 1975, p. 176), zinc coatings are characterized by high dependence of gas-permeability from spraying conditions, as compared for instance to aluminium ones.

Nevertheless, in the coatings produced by gas-dynamic methods the structure of boundaries between the particles may differ greatly from the similar structure of the typical gas-thermal coatings. Therefore, the employment of zinc might produce a beneficial effect.

However, at the moment of making this invention there has been no information in the literature on the fact whether the presence of zinc in the powder material to be sprayed by the gas-dynamic method contributes to a reduction in gas-permeability of the coatings, nor has been there any information on the amount of zinc to be present in the powder material in order to ensure good impermeability of the coating and high coating bond strength.

There has been no information on the optimal range of temperatures of heating of the compressed gas with the use of which the powder particles are accelerated. Taking into account the fact that with an increase in temperature the plasticity of zinc is increased (which must promote more complete filling of the gaps between the particles in the coating), it would be well to raise the gas temperature. Nevertheless, the previous experience (RU 2062820) has shown that when employing a powder mixture comprising zinc, at a gas temperature of 400° C. and above, intensive sticking of the powder to the nozzle walls takes place.

Thus, it was neither known nor obvious beforehand to which extent the presence of zinc in the coating would aid in reducing its gas-permeability and which would be the optimal values for the amount of zinc in the powder material and for the temperature of working gas heating to produce impermeable coatings with low gas-permeability and high bond strength with a substrate (base material).

In order to obtain answers to these questions, the special studies have been made. It has been found out, in particular, that impermeability of coatings is dependent to only a small extent on porosity of the coatings. At low values of porosity typical of gas-dynamic coatings, the more important role is played by the structure of boundaries (tightness) between individual particles forming the coating. To produce a coating with low gas-permeability, it is necessary to ensure tight contact between the particles and most complete filling of all microgaps (which have practically no effect on porosity) at the boundaries between the particles.

It turned out that an addition of zinc powder to the powder material to be sprayed resulted in a considerable reduction in gas-permeability of the coatings. At the same time it has been found out that an increase in compressed air temperature also aids in reducing gas-permeability of the coatings.

The studies made have shown that the presence of zinc in the powder material to be sprayed in an amount less than 20% of the metal powder total weight ensures only slight reduction in gas-permeability. At the content of zinc of more than 60% considerable reduction in coating bond strength takes place. This is caused by the fact that purely zinc coatings have lower coating-to-substrate bond strength than, in particular purely aluminium ones, with all other factors being the same.

When spraying the coatings, air prior to the supply to a supersonic nozzle is preliminary heated thus affording an increase in the temperature of the supersonic air flow by which the powder is accelerated in the supersonic nozzle. In this case, depending on the nozzle portion into which the powder will be introduced (subsonic or supersonic), air heating temperature is so chosen that zinc particles when accelerated efficiently in the nozzle could be simultaneously heated up by the air flow and could increase their plasticity. The experiments have shown that the optimal temperatures to be achieved for preheating compressed air prior to its supply to the supersonic nozzle are in the range from 400 to 700° C. In that case, upon impingement on the previous coating layer, zinc particles being heated up and having high velocity and plasticity form more extensive spots of contact with other particles and fill more easily all micropits on the surface of the coating previous layer and microgaps between the particles adhered before.

At a lower temperature of preheating air, zinc particles do not have enough time for getting warm in the nozzle and remain in the low-plasticity state. Upon impingement of such particles on the coating (the previous layer of the particles), there will still remain microgaps at the boundaries between the particles, and a sufficiently continuous and tight structure of boundaries between the particles in the coating will not be formed. Either the presence or absence of the boundary structure like that has practically no effect on porosity of the coating.

Furthermore, when lowering the temperature of preheating air the air flow rate is reduced and consequently the velocity of powder particles. This leads to a decrease in the probability of bonding the particles with the substrate, and hence, to increased consumption of the power material, to an increase in coating applying time and decrease in process efficiency.

At a higher temperature of preheating air the metal particles, which upon impingement were poorly deformed for various reasons, also start to stick to a substrate surface. At a lower temperature they did not bond with the surface but were flown away or easily knocked down from the surface by other particles. In the event of adhering such particles (at a higher temperature) to the substrate surface, coating bond strength is reduced. Moreover, with an excessive rise in the temperature of preheating air zinc particles can be softened to such an extent that the probability of their sticking to the nozzle inner walls greatly increases despite the presence of ceramic particles in the powder.

The ceramic particles when interacting with a substrate clean the latter from contaminants and produce the developed microrelief of the surface, as a result an increase in coating bond strength is ensured. Besides, these particles hit the metal particles adhered, and due to high hardness of ceramics they deform them additionally and tamp them down thus reducing porosity of the coating. A significant fact is also that the ceramic particles while moving in the nozzle clean the nozzle walls from the metal particles being stuck thereto. This permits the working gas temperature to be considerably increased with no fear that the particles will stick to the nozzle walls.

Examples of the specific application of the invention are given in the Table below wherein for comparison purposes the averaged measurements of various characteristics are shown with regard to the coatings produced by the method of the present invention when spraying the powders of different compositions. The coatings were applied by using an apparatus for gas-dynamic application of coatings. Said apparatus provides heating of compressed air, supply it to a supersonic nozzle, introduction of a powder material into a supersonic flow and acceleration of the powder material by this flow. The content of metals is expressed as a percentage of the metal powder total weight in the powder material. In all the cases, the amount of the ceramic material (aluminium oxide) made up 30% of the total weight of the powder material. Gas-permeability was measured using identical specimens having a coating thickness of 0.5 mm and a pressure differential of 20 atm. To measure coating bond strength, the pin method was used.

TABLE

| Aluminium, % | Copper, % | Zinc, % | Air Temperature ° C. | Adesion, MPa | Gas-Permeability, $10^{-3}$ 1/hr. | Porosity, % |
|---|---|---|---|---|---|---|
| 100 | 0 | 0 | 600 | 58 | 3 | 8 |
| 80 | | 20 | 600 | 50 | 0.05 | 5 |
| 40 | | 60 | 600 | 32 | <0.01 | 3 |
| 60 | | 40 | 600 | 41 | <0.01 | 3 |
| 60 | | 40 | 400 | 55 | 0.02 | 4 |
| 60 | | 40 | 700 | 35 | 0.01 | 5 |
| 0 | 50 | 50 | 600 | 35 | 0.01 | 4 |
| 20 | 50 | 30 | 600 | 45 | <0.01 | 4 |
| 0 | 80 | 20 | 600 | 33 | 0.2 | 6 |

It can be seen from the Table that the best result has been achieved when zinc content in the powder material makes up from 20 to 60% of the metal powder weight and compressed air is preheated to a temperature ranging from 400 to 700° C.

The above-given practical examples have shown that the realization of this method enables one to produce the coatings having low gas-permeability and good coating bond strength.

In order to produce the coatings of high quality, it is advantageous that a ceramic powder with a particle size of from 5 to 50 $\mu$m be used as a ceramic material. If the particle size of the ceramic particles in the powder is less than about 5 $\mu$m, they are quickly retarded in the slowed down air layer in front of the substrate. Since such particles have a low speed of impact on a substrate, they poorly clean the substrate surface and have little stimulating effect on compaction of the coating. With a particle size of more than about 50 $\mu$m the effect is the reverse. Such particles cause a large erosion effect. They not only compact the coating being formed but cut off a major portion of it. This finally leads to a reduction in efficiency of the spraying process as a whole.

It is advisable that silicon carbide or a mixture of silicon carbide and aluminum oxide be employed as a ceramic material. Silicon carbide is more expensive. However, silicon carbide powder particles, at high-speed impacts on a substrate, emit light thus permitting the spraying spot to be observed. In the course of performing different kinds of work (for instance repair) such visualization is very convenient.

The method is characterized by simplicity and low cost. It may be employed for the repair of various products, such as automotive components, and in particular motor parts and automotive air-conditioning systems.

What is claimed is:

1. A coating method comprising:

preheating air to 400 to 700° C.;

forming an airflow of the preheated air in a supersonic nozzle;

providing and accelerating a powder material in the supersonic nozzle; and applying the accelerated powder material to a product surface;

wherein the powder material comprises a mechanical mixture of ceramic powder and metal powder;

wherein the metal powder comprises a powder mixture of at least two metals, one of which comprises zinc powder; and wherein the zinc powder comprises 20 to 60% of a total weight of the metal powder.

2. The method according to claim 1, wherein the metal powder further comprises aluminum powder.

3. The method according to claim 1, wherein the metal powder further comprises copper powder.

4. The method according to claim 1, wherein the metal powder further comprises aluminum powder and copper powder.

5. The method according to claim 1, wherein the ceramic powder has a particle size of 5 to 50 $\mu$m.

6. The method according to claim 1, wherein the ceramic powder comprises aluminum oxide.

7. The method according to claim 1, wherein the ceramic powder comprises silicon carbide.

8. The method according to claim 1, wherein the ceramic powder comprises a mechanical mixture of aluminum oxide and silicon carbide.

* * * * *